US006613993B1

(12) United States Patent
Strümpler

(10) Patent No.: US 6,613,993 B1
(45) Date of Patent: Sep. 2, 2003

(54) MICRORELAY WORKING PARALLEL TO THE SUBSTRATE

(75) Inventor: Ralf Strümpler, Gebenstorf (CH)

(73) Assignee: ABB Research Ltd., Zurich (CH)

( * ) Notice: Subject to any disclaimer, the term of this patent is extended or adjusted under 35 U.S.C. 154(b) by 0 days.

(21) Appl. No.: 09/936,836

(22) PCT Filed: Mar. 17, 2000

(86) PCT No.: PCT/CH00/00152

§ 371 (c)(1),
(2), (4) Date: Sep. 18, 2001

(87) PCT Pub. No.: WO00/57445

PCT Pub. Date: Sep. 28, 2000

(30) Foreign Application Priority Data

Mar. 20, 1999 (DE) ..... 199 12 669

(51) Int. Cl.[7] ..... H01H 59/00
(52) U.S. Cl. ..... 200/181; 361/233; 361/283.1
(58) Field of Search ..... 200/181; 333/101–108, 333/262; 361/233, 283.1–290; 73/514.01–514.38

(56) References Cited

U.S. PATENT DOCUMENTS 5,025,346 A 6/1991 Tang et al.
6,144,545 A * 11/2000 Lee et al. ..... 200/181 X

FOREIGN PATENT DOCUMENTS

DE 4205029 C1 2/1993
DE 4229068 A1 3/1994
DE 19800189 A1 7/1999
FR 2706075 12/1994
WO WO93/03385 2/1993

OTHER PUBLICATIONS

Micromechanical Membrane Switches on Silicon, Petersen, IBM Publication, 1979, pp. 376–385.
"Three–dimensional silicon electrostatic linear microactuator", Tirole, et al., *Sensors and Actuators A 48*, Elsevier Science S.A., 1995, pp. 145–150.
"Surface micromachining for sensors", Electronic Engineering, Nov. 1991, pp. 9–11.
"Simplified Process in Used to Mark Micromachined FET–Like Four–Terminal Microswitches and Microrelays", R. Allan, Electronic Design, Jul. 8, 1996, pp. 3, 32.
"Vertical Mirrors Fabricated by Deep Reactive Ion Etching for Fiber–Optic Switching Applications", C. Marxer, et al., Journal of Microelectromechanical Systems, vol. 6, No. 3, Sep. 1997, pp. 277–285.
"Silicon–Microrelay with Electrostatic Moving Wedge Actuator—New Functions and Miniaturisation by Micromechanics", Schlaak, et al., Siemens AG publication, 1996, pp. 463–468.
"New electro–magnetic contractor with wide control voltage range", P. Stephansson, et al., ABB Review Jan. 1997, pp. 29–32.

* cited by examiner

*Primary Examiner*—J. R. Scott
(74) *Attorney, Agent, or Firm*—Burns, Doane, Swecker & Mathis, L.L.P.

(57) ABSTRACT

The invention relates to a novel micro relay for switching electric currents, in which a movable contact piece 1 moves parallel to the substrate.

22 Claims, 3 Drawing Sheets

MICRORELAY WORKING PARALLEL TO THE SUBSTRATE

FIELD OF THE INVENTION

This invention relates to a micro relay for switching an electric current on and off.

BACKGROUND OF THE INVENTION

Conventional relays, for example electromagnetic contactors, are electromagnetically operated switches having a moving contact piece, which is operated by the interaction of an electromagnet with a moving part of its core. Instead of providing a detailed description of this prior art, reference is made, by way of example, to "New Electromagnetic Contactor with Wide Control Voltage Range" by P. Stephansson, H. Vefling, G. Johansson, Cl. Henrion in ABB Review 1/1997, pages 29 et seq.

As an alternative to such conventional relays, what are referred to as micro relays have been developed and investigated recently. The prior art relating to these is contained, for example, in H. F. Schlaak, F. Arndt, J. Schimkat, M. Hanke, Procedure. Micro System Technology 96, 1996, pages 463–468. Reference is also made to: R. Allen: "Simplified Process is Used to Make Micromachined FET-like Four-Terminal Microswitches and Microrelays" in Electronic Design, Jul. 8, 1996, page 31.

In general, micro relays are mounted on a substrate and have a movable contact piece on the substrate with the contact piece being suspended elastically, and with the drive for the contact piece being operable electrically. The drive, which may, for example, operate electrostatically, electromagnetically or piezo-electrically, is used to move the movable contact piece from an open position to a closed position, or vice versa, with the elastic suspension providing a resetting force. In this case, the individual parts may also be combined, for example with the contact piece having elastic characteristics or being part of the drive.

Micro relays are produced using the known processes from semiconductor technology or comparable microengineering processes and, to this extent, are particularly suitable for integration with other semiconductor devices, in particular integrated circuits or transistors.

In addition, particularly in comparison to conventional electromagnetic relays, micro relays have extraordinarily fast response times, owing to the small moving masses. At the same time, the switching power levels required are very low, so that considerable power savings can be achieved, particularly when using a number of them in a relatively large circuit.

Furthermore, in many applications, it is of considerable interest that, since they are physically small, modern micro relays not only occupy small physical volumes but also have correspondingly low weights. Finally, when suitably encapsulated, they are extraordinarily insensitive both to mechanical loads and to thermal loads, once again owing to their small physical size and the small moving masses. Technicians therefore have very much more flexibility when using micro relays than with conventional electromagnetic relays.

SUMMARY OF THE INVENTION

The invention is based on the technical problem of finding a micro relay which is better than the prior art.

The invention solves this problem by means of a micro relay having a substrate, a movable contact piece on the substrate, an elastic suspension of the movable contact piece and an electrically operable drive for the movable contact piece, characterized in that the movable contact piece can be moved essentially parallel to the substrate, in the suspension, by the drive, and by a process for producing a micro relay of the type mentioned above, in which the movable contact piece with at least one major part of its functional structure in the form of a two-dimensional structure in a plane parallel to the substrate.

Particular refinements of the invention are the subject matter of the dependent claims.

The micro relay according to the invention is thus distinguished by the fact that the movable contact piece has a movement direction parallel to the substrate. The movable contact piece thus, to a certain extent, moves in a planar fashion and not, as in the prior art, more or less at right angles to the plane of the substrate. This results in various options for technical improvements. Firstly, the entire micro relay can be designed to be essentially two-dimensional, which considerably simplifies the use of typical microtechnological processes, in particular with regard to the necessary lithography, etching and coating steps. Secondly, this makes it possible to avoid parts of the micro relay projecting to a relatively major extent from the micro relay in the direction at right angles to the plane of the substrate, thus impeding subsequent lithography steps, for example in conjunction with adjacent microelectronic circuits. Finally, a flat structure can also simplify the possibilities for subsequent encapsulation or protection by a cover or the like.

In particular, it is preferable to design the structure of the micro relay to be two-dimensional, either as far as possible in its entirety or else partially, that is to say the structure of the movable contact piece, of the drive or of the elastic suspension. This means that, when designing the geometry, those structural elements which govern the function are chosen to be two-dimensional in the substrate plane and, accordingly, can be produced easily and in a standard manner using lithography and structuring.

It is thus advantageous to work with buried layers under the layer which forms the parts that are constructed two-dimensionally to this extent, in which case the buried layers can be removed at suitable points, in order to detach specific parts from the substrate and hence, for example, to design them such that they are elastic or movable.

With regard to the parallelity of the technology with microelectronic processes, silicon may be used as the structure material, not least because, with appropriate doping and depending on the requirement, it can also be designed to be virtually insulating or else electrically conductive. This can also be done in a manner matched to the micro relay structure, by means of appropriate implantation or diffusion steps.

Buried layers may be composed, for example, of silicon dioxide, to be precise likewise to maximize the points of contact with the established semiconductor processes.

When using silicon on silicon dioxide or some other insulator, SOI (silicon on insulator) structures which have been introduced can be made use of in this case, in particular when monocrystalline silicon is preferred as the basic material, on an SIMOX wafer.

The advantageous structuring processes for two-dimensional structuring of the micro relay are generally ion etching processes and, in particular, RIE processes. Assuming the process is controlled appropriately, ion etching processes allow virtually vertical flanks to be produced in various materials, with depths which are completely sufficient for this application. These processes are furthermore uniform, even when the surfaces to be processed are relatively large, and are highly suitable for automated mass production. In addition to other established ion etching processes, the RIE process is distinguished by a large choice of known processes for widely differing materials, while the hardware complexity is at the same time acceptable, and the etching rates are relatively high.

For a technological example relating to this, reference shall be made to "Vertical Mirrors Fabricated by Deep Reactive Ion Etching for Fiber-Optic Switching Applications" by C. Marxer et al., Journal of Microelectromechanical Systems, Volume 6, No. 3, September 1997, pages 277–285. This document describes microoptical switches for fiber-optic applications, which have been structured by means of an RIE process in silicon on buried silicon dioxide layers with 75 $\mu$m-high vertical walls. The disclosure in this document is included here by way of reference.

A contact surface of a contact piece can be connected to the drive by means of a rod which is arranged parallel to the substrate and preferably has a lattice structure, in order to achieve good robustness with low weight. This allows structures to be produced which are insensitive to vibration and shock, respond quickly and have high resonant frequencies. With respect to the two-dimensional structure which is preferred for this invention, this lattice structure can be produced in an advantageous manner by two-dimensional structuring of the micro relay.

Furthermore, the movable contact piece may have an oblique contact surface, to be precise a surface which runs obliquely with respect to the movement direction while at the same time runs essentially at right angles to the plane of the substrate. The oblique arrangement of the contact surface can result in a relatively large contact area when in contact with a corresponding, complementary contact surface of a stationary contact piece, without the movable contact piece needing to have an excessively large physical extent. At the same time, the oblique angle enclosed between the movement direction and the contact surface can also result in the power of the drive being stepped up, especially if there is a corresponding second contact surface, or some other contact point, on the side of the movable contact piece opposite the contact surface.

If the movable contact piece or a stationary contact piece is designed such that it results in a detectable transverse component between respective contact surfaces, that is to say a movement component in the surface direction, during the closing movement, for example by one contact piece bending, this allows the contact quality to be improved.

An electrostatic configuration is preferable for the drive, since, in comparison to electromagnetic or piezoelectric drives, it has the advantage of both low supply powers and low supply voltages. In order to compensate for the fundamental disadvantage of electrostatic drives, namely the relatively low drive forces, a finger structure is preferred, which is arranged in a toothed manner, and can actually be produced in a worthwhile manner during the two-dimensional structuring discussed according to the invention.

The elastic suspension is preferably provided by at least one meandering web. The details of these geometric shapes will be explained in more detail in the description of the exemplary embodiment.

Finally, the invention also provides the possibility of incorporating an arcing chamber structure, which is known from conventional circuit breakers, as is described in more detail in the third exemplary embodiment.

As stated, the invention relates both to a novel micro relay structure and to a two-dimensional structuring process designed for this purpose. Accordingly, the above statements relating to the various individual aspects of the invention should be understood as relating both to the disclosure of appropriate apparatus features and to process features.

BRIEF DESCRIPTION OF THE DRAWINGS

Further details of the invention will be explained in more detail with the aid of the following three exemplary embodiments of the invention. The individual features disclosed in this case may also be essential to the invention in other combinations.

In the figures.

DETAILED DESCRIPTION OF THE INVENTION

The exemplary embodiments described in the following text may be produced using the technology described in the cited publication by C. Marxer et al., in which case the contact surfaces can be applied at an oblique angle by means of appropriately reinforced vapor deposition processes. In principle, electrolytic contact reinforcements at selected points are also possible.

Figure 1:
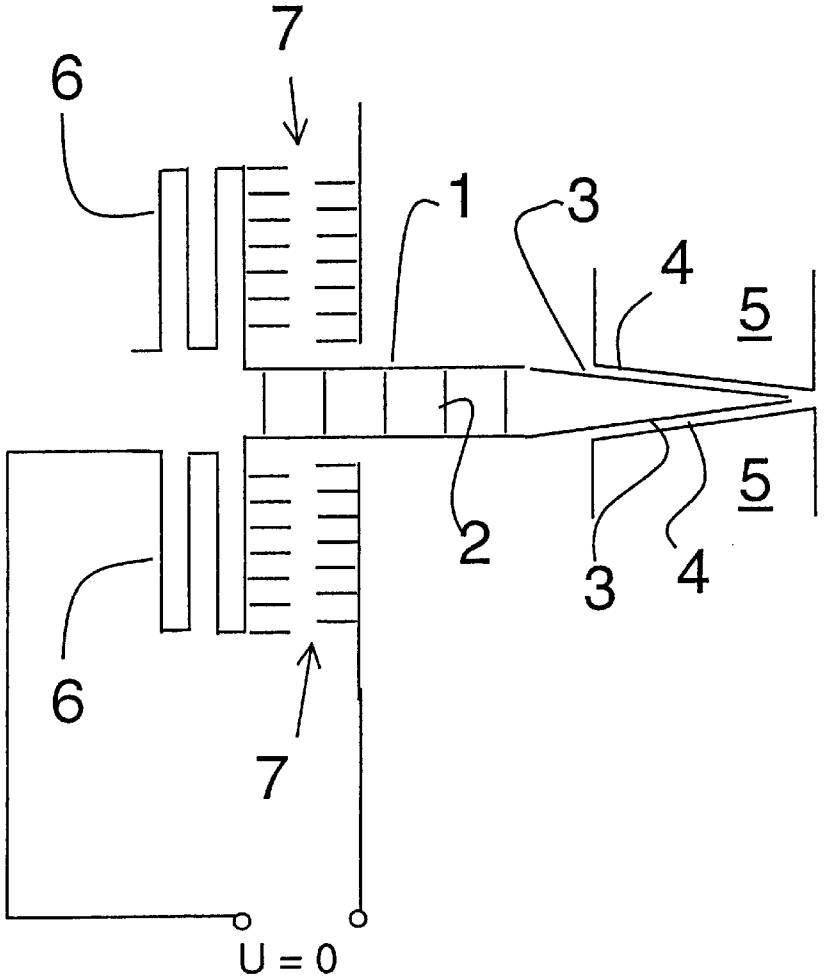
FIGS. 1 and 2 show the first exemplary embodiment with the micro relay opened and closed, respectively.
Figure 2:
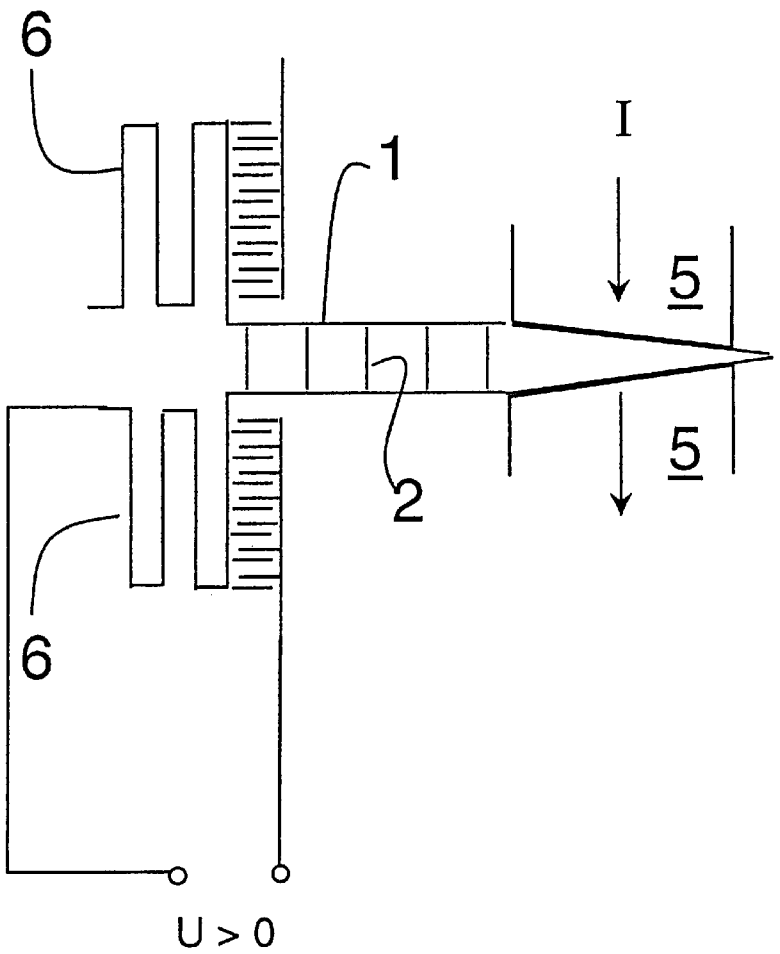

FIGS. 1 and 2 show a first exemplary embodiment with a movable contact piece which has a rod 1, which lies in the movement direction and has a lattice structure formed by transversely running struts. On the side of the rod 1 on the right in the figure there are two contact surfaces 3, which run obliquely with respect to the movement direction that corresponds to the horizontal in the figures and at right angles to the plane of the substrate (which corresponds to the plane of the drawing), on the movable contact piece, and two complementary contact surfaces 4 on a stationary contact piece 5.

The movable contact piece can move in the horizontal direction in FIG. 1, that is to say parallel to the substrate, by virtue of an elastic suspension in a double meandering web structure 6. In this case, FIG. 1 shows the micro relay when it is open, in which case two parts of the stationary contact piece 5 are disconnected from one another while, in contrast, FIG. 2 shows the micro relay closed, in which case the movable contact piece connects the two parts of the stationary contact piece 5. The current flow 1 which is now possible is indicated.

The removal of a buried silicon dioxide layer from the substrate results in detachment of the entire movable contact piece, including the side of the drive 7 on the left in the figures, and including the elastic suspension 6. The other illustrated parts, in particular the stationary contact piece 5 and the side of the drive 7 on the right in the figures, are firmly connected to the substrate by the buried silicon dioxide layer.

The force required for movement is produced by a toothed finger structure, which is annotated 7 and is operated by applying a voltage U in the manner illustrated in FIGS. 1 and 2. In FIG. 1, the fingers are illustrated separated from one another to an exaggerated extent and, when open, they may also extend into one another. The state when no voltage is applied therefore corresponds to the open position illustrated in FIG. 1 while, in contrast, when a positive voltage is applied, the electrostatic attraction overcomes the resetting force of the elastic suspension 6, thus resulting in the closed position.

The meandering webs of the elastic suspension 6 and the fingers of the drive 7 can be made electrically conductive by appropriate doping. In contrast to this, the lattice structure of the rod 1 is designed to be insulating, in order to isolate the drive from the potential of the switched path. The contact surfaces 3 and 4 are covered with gold, deposited obliquely in an appropriate manner by vapor deposition; the stationary contact piece 5 may in this case correspond to a relatively solid metallic interconnect. In order to reduce the resistance in the closed position, the tip of the movable contact piece on the contact side can be covered with a sufficiently thick metal layer between the two oblique contact surfaces 3, thus electrically connecting the two contact surfaces 3.

The illustrated situation of a relay that is open with no voltage applied corresponds to the normal configuration of conventional electromagnetic relays, but is not essential. It can also be opened by electrostatic repulsion, or by electrostatic attraction of fingers applied appropriately in the opposite sense, with voltage being applied to a micro relay structure which is essentially closed by the elastic suspension 6.

Figure 4:
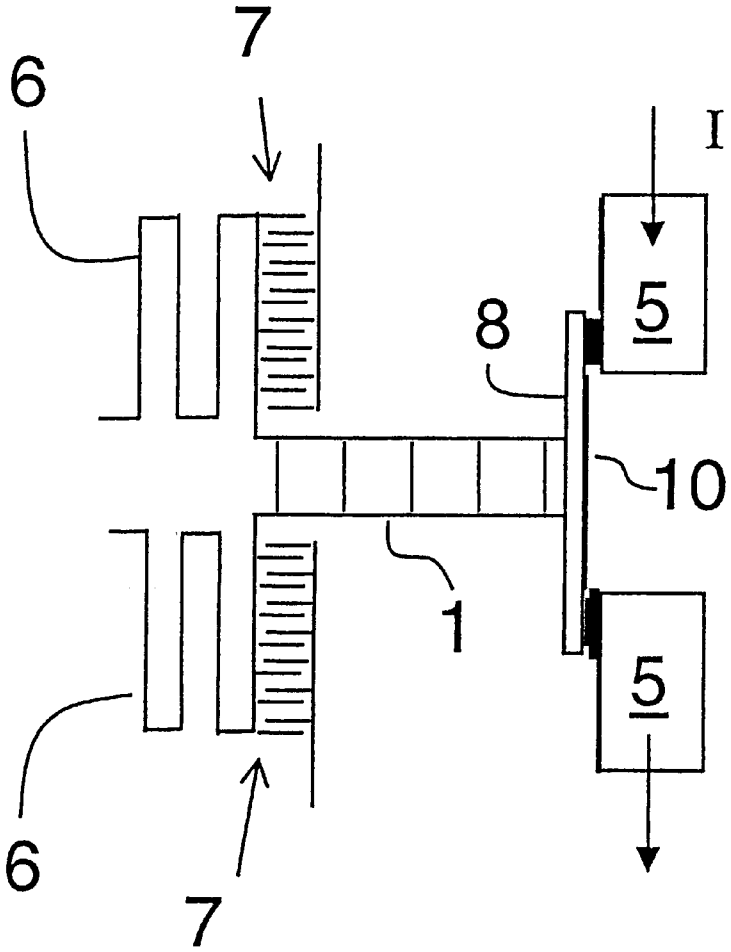
FIGS. 3 and 4 show the second exemplary embodiment, opened and closed, respectively.
Figure 3:
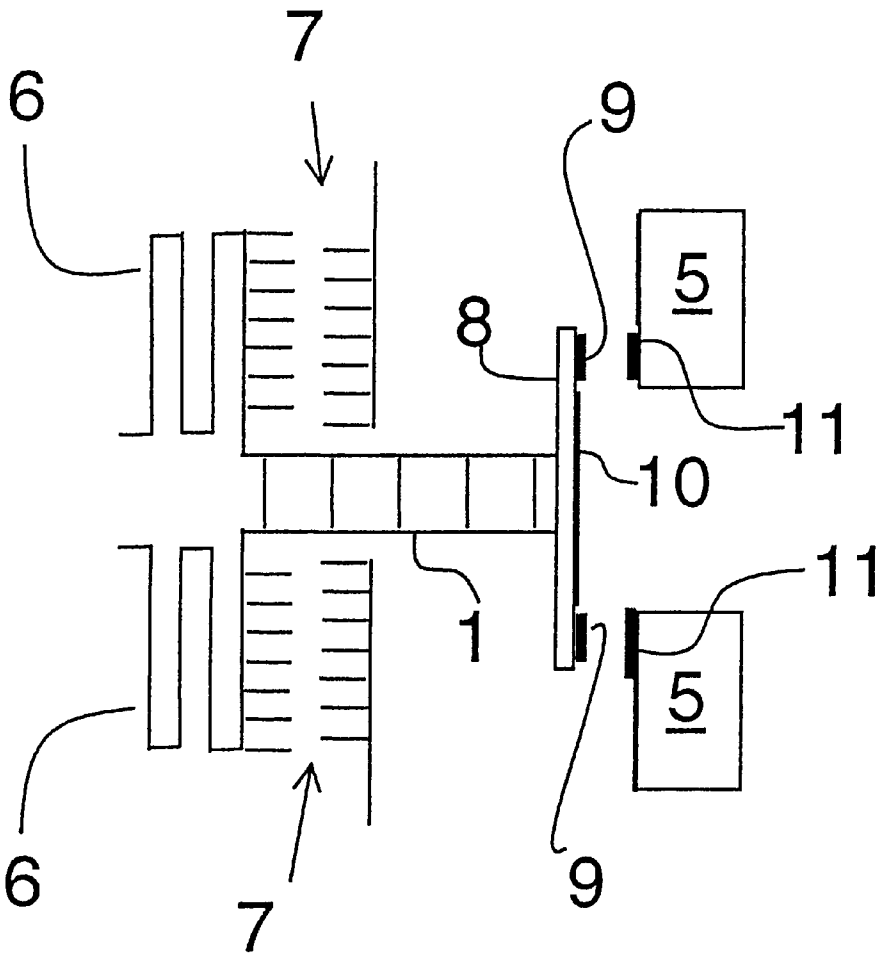

FIGS. 3 and 4 show a second exemplary embodiment, and in this case only those details which differ from the first exemplary embodiment will be explained.

To be precise, the lattice structure 2 of the movable contact piece on the contact end of the contact piece rod 1 has a bar 8, which runs essentially transversely with respect to the direction of the rod and has reinforced metal structures 9 located at both of its ends, and these are connected by a metallic link 10. Analogous contact surfaces 11 are located on each of two parts of the stationary contact piece 5, opposite the contact surfaces 9. In the closed position illustrated in FIG. 4, this structure has the advantage that slight bending of the bar 8 results in a small movement component between the contact surfaces 9 and 11 transversely with respect to the closing direction of the micro relay. From experience, this improves the quality of the contact.

Figure 6:
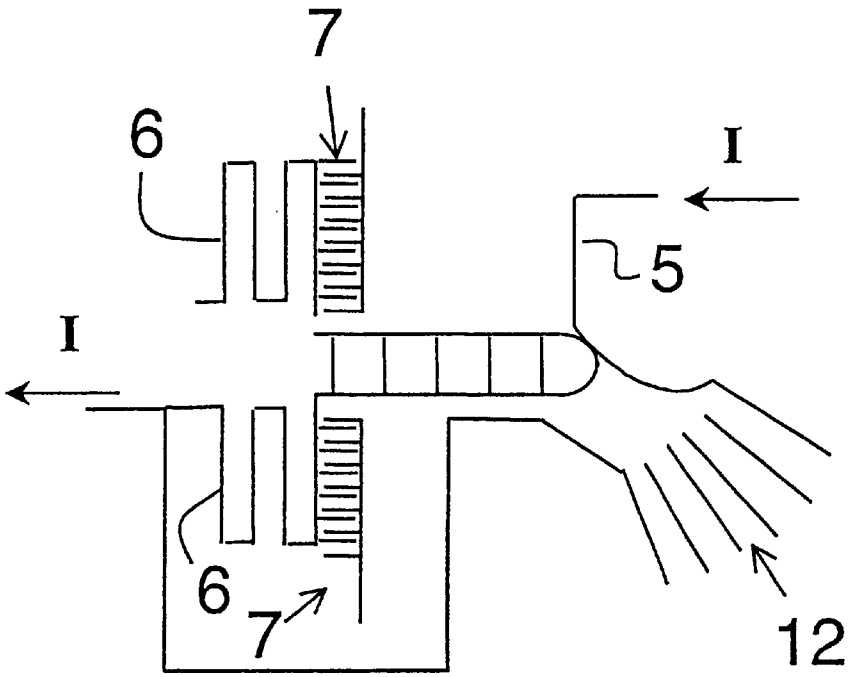
FIGS. 5 and 6 show the third exemplary embodiment, opened and closed, respectively.
Figure 5:
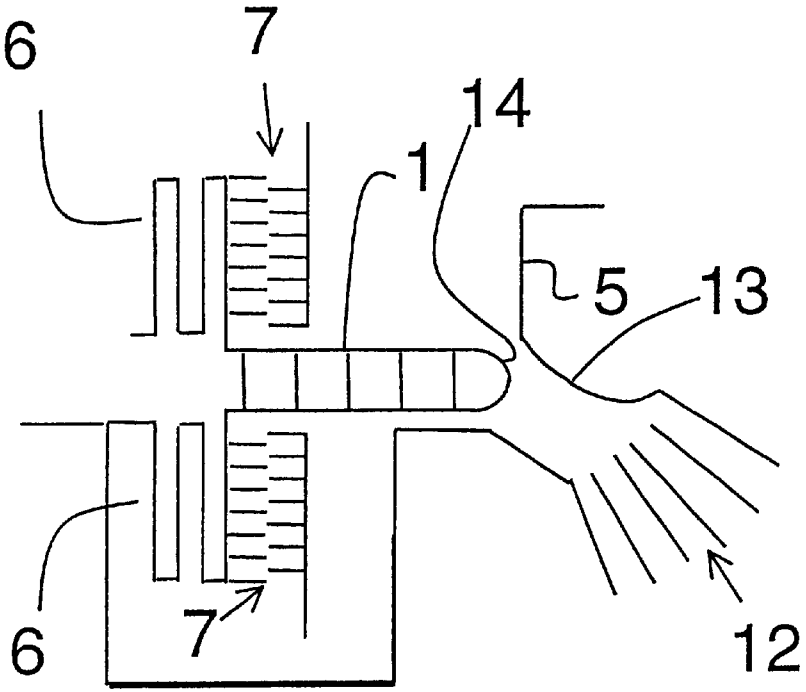

The third exemplary embodiment in FIGS. 5 and 6 shows a version with an arcing chamber structure 12 which is formed from vertical silicon webs that are mounted on the substrate so that they are electrically isolated by the buried silicon dioxide layer. When the micro relay is being opened, that is to say when the movable contact piece is being moved from the closed position illustrated in FIG. 6 to the open position illustrated in FIG. 5, an arc can be forced into the arcing chamber 12 by the rounded shape of the stationary contact piece 5 at the point annotated 13, and by the rounded shape of the contact end 14 of the movable contact piece along the structure 13, which acts as a guide rail. In this case, 12 results in the arc having a curved shape. In this case, it is important for the arc to have a curved shape, by virtue of suitable shaping at 13 and 14. Apart from this, the third exemplary embodiment differs from the first and second in that the movable contact piece cannot connect, for example, two separate parts of the stationary contact piece 5, but itself forms a part of the current path to be switched. This is illustrated in FIGS. 5 and 6 by a bold line in the region of the current path, that is to say in the region of the stationary contact piece 5, the arcing chamber 12, the movable contact piece, that is to say the rod 1 (which in this case is conductive), the meandering suspension structure 6 at the bottom in FIGS. 5 and 6, and the conductive connection between the arcing chamber 12 and the end of the structure on the left in FIGS. 5 and 6.

What is claimed is:

1. A micro relay having a substrate a movable contact piece on the substrate, an elastic suspension for the movable contact piece, and an electrically operable drive for the movable contact piece, wherein the movable contact piece can be moved essentially parallel to the substrate, in the suspension, by the drive.

2. The micro relay as claimed in claim 1, in which the movable contact piece has at least one major part of its functional structure in the form of a two-dimensional structure in a plane parallel to the substrate.

3. The micro relay as claimed in claim 1, in which the elastic suspension has at least one major part of its functional structure in the form of a two-dimensional structure in a plane parallel to the substrate.

4. The micro relay as claimed in claim 1, in which the drive has at least one major part of its functional structure in the form of a two-dimensional structure in a plane parallel to the substrate.

5. The micro relay as claimed in claim 2, having a buried layer, which is arranged between the two-dimensional structure and the substrate and is removed under movable structure parts.

6. The micro relay as claimed in claim 2, in which the two-dimensional structure is composed essentially of silicon.

7. The micro relay as claimed in claim 5, in which the buried layer is composed essentially of silicon dioxide.

8. The micro relay as claimed in claim 1, in which the movable contact piece has a rod which is arranged parallel to the substrate and connects a contact surface to the drive.

9. The micro relay as claimed in claim 8, in which the rod has a lattice structure.

10. The micro relay as claimed in claim 1, in which the movable contact piece has a contact surface which runs obliquely with respect to the movement direction and at right angles to the substrate.

11. The micro relay as claimed in claim 1, in which any movement of the movable contact piece which closes the micro relay results in a transverse movement component between contact surfaces on the movable contact piece and a stationary contact piece.

12. The micro relay as claimed in claim 1, in which the drive has an electrostatically acting toothed finger structure.

13. The micro relay as claimed in claim 1, in which the elastic suspension has a meandering web.

14. The micro relay as claimed in claim 1, having an arcing chamber structure.

15. A process for producing a micro relay as claimed in claim 1, in which a two-dimensional structuring process parallel to the substrate is used to provide the movable contact piece with at least one major part of its functional structure.

16. A process for producing a micro relay as claimed in claim 1, in which a two-dimensional structuring process parallel to the substrate is used to provide the drive with at least a major part of its functional structure.

17. A process for producing a micro relay as claimed in claim 1, in which a two-dimensional structuring process parallel to the substrate is used to provide the elastic suspension with at least a major part of its functional structure.

18. The process as claimed in claim 15, in which the two-dimensional structuring process is an ion etching process.

19. The process as claimed in claim 18, in which the ion etching process is an RIE process.

20. The process as claimed in claim 15, in which a buried layer which is arranged between the two-dimensional structures, and the substrate is partially removed in order to detach structure parts from the substrate.

21. The process as claimed in claim 15, in which the two-dimensional structures are composed essentially of silicon.

22. The process as claimed in claim 20, in which the buried layer is composed essentially of silicon dioxide.

* * * * *